US005399282A

United States Patent [19]

Hansen et al.

[11] Patent Number: 5,399,282

[45] Date of Patent: Mar. 21, 1995

[54] DUSTING AND CLEANING COMPOSITION

[75] Inventors: Kathryn E. Hansen, Cincinnati, Ohio; Luz P. Requejo, Racine, Wis.

[73] Assignee: Kiwi Brands, Inc., Douglassville, Pa.

[21] Appl. No.: 179,154

[22] Filed: Jan. 10, 1994

Related U.S. Application Data

[63] Continuation-in-part of Ser. No. 58,913, May 6, 1993, abandoned.

[51] Int. Cl.[6] ..... C11D 7/50; C11D 7/22

[52] U.S. Cl. ..... 252/162; 252/139; 252/153; 252/171

[58] Field of Search ..... 252/162, 139, 153, 171

[56] References Cited

U.S. PATENT DOCUMENTS 4,859,359 8/1989 DeMatteo et al. ..... 252/162

5,204,016 4/1993 Hamilton et al. ..... 252/162

*Primary Examiner*—Arthur C. Prescott

*Attorney, Agent, or Firm*—John Lezdey

[57] ABSTRACT

A dusting and cleaning composition particularly suited for cleaning furniture and similar surfaces, including one or more paraffinic or naphthenic oils, one or more volatile organic solvents, terpene, a glycol ether, a compatible emulsifier system, and water, wherein the cleaning composition is in the form of a readily breakable oil-out emulsion.

15 Claims, No Drawings

DUSTING AND CLEANING COMPOSITION

RELATED APPLICATIONS

This application is a continuation-in-part of application Ser. No. 08/058,913, filed May 6, 1993, now abandoned.

BACKGROUND OF THE INVENTION

1. Field of the Invention

This invention relates to an improved dusting and cleaning composition particularly suited for cleaning furniture and similar surfaces. More particularly, the new composition has superior cleaning, rub-out, and shining properties, and at least equivalent dust pick-up as compared to currently available compositions, while at the same time offering a significantly reduced amount of volatile organic components.

2. Description of the Prior Art

In order to effectively clean furniture and similar surfaces (e.g., formica-topped structures), it is often necessary to utilize various cleaning and dusting compositions. A dusting composition is simply any product that will aid in the removal of dust from the surface being cleaned. Due to the nature of these surfaces, however, it is necessary to ensure that the compositions utilized will not harm the finish while they are cleaning. Thus, it is usually not desirable to employ harsh solvents or merely water, especially when the surface is finished wood. Harsh organic solvents can destroy the finish, prevent the surface from taking on a desired shine or wax coating, or even destroy the wood itself. Water can also be damaging to the finish and/or the wood itself. It is also desirable that these cleaning products enhance the ability to remove dust from the surface, and leave a shine after wiping either with or without the laying down of a wax layer.

Various compositions have been employed to achieve these goals, and a number of such products are currently marketed. One significant drawback to these compositions is the presence of volatile organic components ("VOC's"), which are obviously not environmentally desirable. In fact, some regulations now severely restrict the amount of VOC's which may be present in these compositions. For example, the state of California has recently imposed a VOC limit of 35% for dusting products, and this limit will be further reduced in the near future. Merely reducing the amount of VOC's present in these compositions is problematic, however, as their cleaning ability is often greatly inhibited by such a reduction. VOC's usually improve the ability of the composition to dissolve, and thereby remove, oily, greasy and waxy stains on furniture. VOC's can also enhance the ability of the product to leave a desired shine on the surface after wiping, as well as, the ease by which the shine is imparted. Heretofore, there has not been an available cleaning and dusting composition having a significantly reduced VOC level, while at the same time offering improved or equivalent cleaning, dusting, and shining properties.

U.S. Pat. No. 4,414,128 to Goffinet discloses an aqueous liquid detergent composition comprising 1–20% surfactant; 0.5–10% terpene, the ratio of surfactant to terpene being 5:1 to 1:3; and 0.5–10% of a select polar solvent, which includes $C_{6-9}$ alkyl ethers of ethylene glycol, the solvent having a water solubility at 25° C. of 0.2–10%.

U.S. Pat. No. 3,933,674 to Farnsworth discloses a composition comprising 5–92% of a hydrocarbon oil of substantially the boiling range of kerosene, which is substantially free of objectionable odor and having not more than 5% sulfonatable constituents; 5–90% limonene-type citrus distillate of stated properties; 0.5–6% of a skin lubricant selected from lanolin and wool grease, and 0.5–3% of a surface active agent.

U.S. Pat. No. 4,749,509 to Kacher claims an aqueous cleaning composition consisting essentially of 0–15% surfactant; 0.5–70% detergency builder, and 0.5–15% diethylene glycol monohexylether.

U.S. Pat. No. 4,790,951 to Frieser discloses a liquid cleaning preparation for removing the fason oil from hard surfaces of the type containing an anionic or nonionic surfactant; a water soluble builder; a water-miscible solvent; 0.25–5% of a terpene and 0.25–5% of a water insoluble polar solvent which is completely or partially hydrogenated naphthalene.

SUMMARY OF THE INVENTION

While not exclusive, the following describes some of the important features and objects of the present invention.

It is an object of the present invention to provide a cleaning and dusting composition having a significantly reduced level of VOC's, while exhibiting improved or equivalent cleaning, dusting, and shining properties as compared to similar products having higher VOC levels.

In accordance with one aspect of the present invention, there is provided a cleaning and dusting composition comprising:

a) one or more paraffinic or naphthenic oils;
b) one or more volatile organic solvents;
c) terpene;
d) a glycol ether;
e) a compatible emulsifier system; and
f) water;

wherein said composition is in the form of a readily breakable oil-out emulsion.

More particularly, there is provided a cleaning and dusting composition for aerosol or non-aerosol application which comprises:

a) from about 5% to about 40% by weight of a paraffinic or naphthenic oil;
b) from about 0.5% to about 20% by weight of a petroleum solvent;
c) from about 0.5% to about 20% by weight of a terpene;
d) a sufficient amount of a glycol ether to improve cleaning properties while maintaining the oil-out emulsion;
e) from about 0.1% to about 2% by weight of an emulsion system comprising a low HLB emulsifier is present in a greater amount in said system; and
f) the remainder water.

DETAILED DESCRIPTION OF THE INVENTION

One particular cleaning and dusting formulation which has achieved widespread success in the marketplace comprises an oil-out emulsion composition. This product is typically sold as an aerosol which is sprayed onto the surface to be dusted and cleaned. After the material deposited on the surface is wiped with a soft cloth or the like, dust is picked-up by the cloth, stains are removed, and an aesthetically pleasing shine is imparted to the surface. The following is the approximate composition of this product (in weight percent, and hereinafter referred to as composition A):

| Ingredients | Weight % |
|---|---|
| Sunpar LW 107 | 24.4 |
| Isopar E | 24.4 |
| Sorbitan Sesquioleate | 0.25 |
| Igepal 710 | 0.05 |
| Deionized Water | 50.5 |

Sunpar LW 107 (manufactured by Sun Refining and Marketing) is a light paraffinic petroleum distillate (i.e., an oil) having a molecular weight of about 250–300 which not only enhances dust pick-up, but also imparts a shine to furniture and similar surfaces after wiping. Isopar E (manufactured by Exxon) is an isoparaffinic petroleum solvent composed principally of $C_8$ isomers which effectively dissolves greasy waxy stains, while also improving the evaporation rate and ease of "rub-out" (i.e., the ability of the product to be wiped off to leave the desired clear shine) of the composition. Sorbitan sesquioleate (such as Arlacel C, which is manufactured by ICI America) is simply an emulsifier which aids in the mixing of oils and other organics with water to form an oil-out emulsion. Igepal 710 (manufactured by Rhone-Poulenc Surfactants) is a water-soluble emulsifier which not only helps to form the oil-out emulsion, but also assists in breaking the emulsion upon use. Other optional ingredients include fragrances and preservatives (such as glutaraldehyde or formaldehyde). Of course, in order to be conveniently provided in a form readily usable by consumers, the above composition is mixed with a suitable propellant. Typically the final product comprises 18% by weight propellant, with the remainder comprising the above-mentioned composition.

As stated above, it is required that these cleaning and dusting compositions be in the form of an oil-out emulsion. An oil-out emulsion (sometimes referred to as a water-in-oil emulsion) simply means that the oil and other nonpolar components (e.g., the solvent) form a continuous phase in which water and water-soluble components are dispersed. It is critical that the emulsion be oil-out, rather than water-out, since water can penetrate into the surface of wood furniture and either damage the wood itself, or cause any wax or finish present to lift away from the wood or other surface being cleaned. It is also important that the oil-out emulsion be readily broken upon use (i.e., when wiped), as this ensures that the water will come into contact with any water-soluble stains, thereby removing said stains.

One significant problem with the above formulation is that the final product contains 38% VOC's (Isopar+-Propellant), which is an environmentally unacceptable level. In fact, in states such as California, this level will soon be illegal for such products. Unfortunately, VOC's such as Isopar and similar solvents are extremely effective for removing greasy and/or waxy stains. In addition, the amount of propellant can generally not be reduced, or else the consumer will have difficulty in completely expelling the product from the can and thereby applying the product to the surface to be cleaned. What is needed, therefore, is a composition wherein the amount of volatile components is significantly reduced, while at the same time not inhibiting, and preferably improving, the desirable properties of cleaning strength, dust pick-up, ease of rub-out, and shine imparting ability.

It has now been discovered that a significant amount of volatile solvents can be eliminated from compositions such as that discussed above and replaced with relatively small amounts (as compared to the amount of solvent eliminated) of terpene and glycol ether. While terpene is obviously volatile itself, the total amount of volatile components present can be reduced while improving the overall properties of the composition. This is truly an unexpected result, as one would normally expect that the cleaning ability of the product, especially for greasy and/or waxy stains, would be greatly reduced if the overall amount of volatile solvents present in the product were decreased. Quite the contrary has been observed. Tests have shown, for example, that the amount of a volatile solvent traditionally employed in these compositions can be reduced by at least 7%, and replaced by only about 2.9% terpene and glycol ether (combined weight), while actually improving the overall performance of the product. This effectively results in a VOC reduction of about 4% while improving such characteristics as cleaning strength. An added benefit is that commonly available citrus terpenes, which are one type of preferred terpene, often contain small amounts of related aldehydes, which impart a pleasant citrus odor to the product.

As stated previously, the maintaining of an oil-out emulsion is critical to the performance of these products. Therefore, the addition of terpene and glycol ether must not interfere with the formation of an oil-out emulsion, as they might be expected. This is particularly true for glycol ethers, as these compounds behave as surfactants to some extent. It has been found, however, that if the amounts utilized are carefully controlled, especially for the glycol ether, an oil-out emulsion can be maintained if an appropriate compatible emulsifier system is employed. In fact, when ethylene glycol monohexyl ether (marketed as hexyl cellosolve by Union Carbide) it was found that less than up to about 1% (by weight) could be added without making the emulsion unstable and possibly forming an undesirable water-out emulsion. Higher levels of glycol ether can also cause the emulsion to either invert to a water-out emulsion or separate into three phases, with the glycol ether in the bottom layer. Since these glycol ethers generally have a high Kauri-butanol value, such a three phase composition could ruin some furniture finishes. The amount of glycol ether that may be employed will vary depending upon which particular one is used, however it is critical that the amount be such that an oil-out emulsion is maintained. While greater amounts of terpene and glycol ether will obviously enhance the ability of the product to dissolve greasy and/or waxy stains, the amount must be controlled so as to maintain the oil-out emulsion and to keep the amount of VOC's present at an acceptable level.

It has also been found that the use of the combination of terpene and glycol ether at controlled levels permits, if desired, a reduction in the amount of oil present, and thus a corresponding increase in the amount of water in the composition. This is in addition to the water that may be added due to the decrease in the amount of volatile solvent employed. Apparently yet another synergistic effect permits such an adjustment without destroying the oil-out emulsion characteristic of the product. In addition, the increase in the amount of water and decrease in amount of oil does not require any change in the emulsifier system employed. In other words, the water phase can be significantly increased, the organic phase (solvents and oil) correspondingly reduced, and the emulsifier system unchanged, while still maintaining the necessary oil-out emulsion. The breaking characteristics of the emulsion, which is obviously also necessary for proper cleaning, are likewise unchanged. This increase in amount of water has a beneficial cleaning effect in that it improves the cleaning ability of the product for water soluble stains. Since the oil is generally needed for dust pick-up and the imparting of a shine to the surface, one would normally expect these qualities to suffer by any significant reduction in the amount of oil present. Quite the contrary occurs, however, as tests actually indicate an improvement in the shine imparting ability, and no decrease in the dust pick-up of the product.

Based upon Applicants' testing, a portion of which is outlined below, one embodiment of their new cleaning and dusting composition comprises (by weight):

| | |
|---|---|
| Paraffinic or Naphthenic Oil | between about 5% and 40% |
| Petroleum Solvent | between about 0.5% and 20% |
| Terpene | between about 0.5% and 20% |
| Glycol Ether | a sufficient amount to improve cleaning properties yet maintain oil-out type emulsion |
| Compatible Emulsifier System | between about 0.1% and 2% |
| Deionized Water | remainder |

It should be kept in kind, as one skilled in the art would understand, the appropriate amount of the compatible emulsifier system will vary depending upon the amount of oil, solvent, terpene and water employed. It is critical, however, that the amount employed be such that the composition remains a readily breakable, oil-out emulsion. Optional ingredients include preservative(s), fragrances, and citrus oils. A preferred preservative is a 25% aqueous glutaraldehyde solution, which may be present up to about 0.5%, and preferably about 0.06%. The amount and type of fragrance(s) used is not critical, since preferences will obviously vary. An added benefit is the solvent characteristics of such oils, as this may enhance the cleaning capability and other properties of the composition, possibly including to a small extent the dust pick-up and shine imparting ability. A preferred citrus oil is orange oil, which may be present up to about 2%, and preferably about 0.5%.

The paraffinic or naphthenic oil(s) may include any of a number of products, however, petroleum or mineral oils are preferred. Animal-source oils are generally not useful, as their unsaturation causes them to become rancid over time. Animal-source oils also contain unacceptable glycerides, are of too high molecular weight, and are generally too viscous. Aromatic oils should also not be used due to their toxicity. While the list of possible oils is extensive, one presently preferred oil is Sunpar LW 107 (sold by Sun Refining and Marketing), which is a light paraffinic petroleum distillate having low volatility and little odor. However, numerous other oils that may be effectively utilized is Diala A (sold by Shell Oil), which is naphthenic oil. A presently preferred amount of oil is approximately 18% in the cleaning composition (absent any propellant), however the range shown above is effective for the desired properties of the final product. For example, the higher levels of oil in the previously given acceptable range can be effectively used to impart more shine to or even provide added conditioning for the surface being cleaned. A preferred range of paraffinic or naphthenic oil is from about 12% to about 20% by weight.

The petroleum solvent(s) employed should be chosen for its ability to dissolve greasy and/or waxy stains of the type typically found on furniture or similar surfaces. Appropriate solvents include aliphatics such as mineral spirits, normal- and isoparaffins, hexane, heptane, and Stoddard solvents. One preferred group of solvents are the Isopars (isoparaffinic solvents sold by Exxon), and a particularly preferred one is Isopar E which is an isoparaffinic petroleum solvent composed principally of $C_{8-9}$ isomers. A presently preferred amount in the cleaning and dusting composition is about 17%, however the range given above is entirely appropriate for cleaning purposes. A preferred range of petroleum solvent is from about 12% to about 20% by weight.

The terpene component of the present compositions are mono -or sesquiterpenes or mixtures thereof which are acyclic (aliphatic terpenes) or preferably monocyclic (limonene) or bicyclic ($\alpha$ and B-terpineol) in structure. Preferred terpenes belong to the class of terpene hydrocarbons and terpene alcohols. Terpene aldehydes and ketones can also be used. The preferred terpenes include terpinene, terpinolene and limonene such the d and d 1-limonenes and dipentenes. These terpene compounds are generally derived from abundant sources of essential oils of citrus plants. For example, the limonenes occur in certain fruit and vegetable sources and the most common sources are by-products of citrus fruit juice production (i.e. orange, grapefruit and lemon rinds).

The terpene alcohol can be a primary, secondary or tertiary alcohol derivative of a cyclic or acyclic terpene hydrocarbon. Suitable tertiary alcohols include terpineol; secondary alcohols include borneol and; primary alcohols such as geraniol.

Wood terpenes which are complex mixtures of terpene hydrocarbons and alcohols are also suitable and are often less expensive than citrus terpenes. For example, oil of pine, oil of fir, oil of juniper which are produced from the distillation of needles and young twigs of the respective woods. The terpene is added at a concentration of about 0.5% to about 20% by weight, preferably 1% to about 5% by weight of the composition and more preferably from about 1.5% to about 2.5% by weight.

Various types of terpenes may be employed in the cleaning and dusting composition described above. Citrus terpenes, and especially orange or lemon terpene are presently preferred. Wood terpenes, such as pine terpene, may also be effectively employed, and are often less expensive than citrus terpenes. A presently preferred amount of terpene in the cleaning and dusting composition is about 2.4%. The terpenes employed in the present invention are preferably derived or found in citrus oils such as orange oil and lemon oil which contains d-limonene.

Possible glycol ethers are numerous, however the most appropriate include diethylene glycol monobutyl ether, diethylene glycol monohexyl ether, ethylene glycol monobutyl ether, and ethylene glycol monohexyl ether. These glycol ethers provide a good balance of cleaning ability and no interference with the maintenance of an oil-out emulsion when appropriate levels are employed. Due to the surfactant properties of these products, the choices are limited by their compatibility with an oil-out emulsion. While those glycol ethers listed can readily be incorporated into the compositions of the present invention, others may effectively be employed by making appropriate adjustments in the compatible emulsifier system. A presently preferred glycol ether is ethylene glycol monohexyl ether (sold as hexyl cellosolve by Union Carbide Corp.), and a preferred amount of this particular glycol ether ranges from about 0.1% to about 1% may be added without adversely affecting the oil-out emulsion characteristics.

With regard to the compatible emulsifier system employed, "compatibility" simply means that the emulsifier(s) used and amounts employed be such that an oil-out emulsion be formed, and that the emulsion be readily breakable upon use (i.e., upon wiping of the sprayed surface). It is permissible for the oil-out emulsion to separate into two phases upon storage, however it must be capable of becoming a homogeneous oil-out emulsion upon slight or moderate shaking of the product. Emulsifiers employed can be nonionic, anionic, amphoteric or zwitterionic. One suitable emulsifier system employs co-surfactants to ensure both an oil-out emulsion and an emulsion that is readily breakable, with one surfactant being oil-soluble (low HLB) while the other is water-soluble (high HLB). As used herein, the terms emulsifier and surfactant are considered to be interchangeable for purposes of this discussion. The term HLB merely refers to the hydrophilelipophile balance, and is a convenient way to characterize particular emulsifiers. The use of a water-soluble emulsifier ensures that the oil-out emulsion can be broken upon use. One presently preferred emulsifier system comprises a combination of an emulsifier having a low HLB (oil-soluble) and an emulsifier having a high HLB (water-soluble). Particularly preferred emulsifier combinations include one having an HLB of about 2–6, and one having an HLB of about 8–18, especially wherein the latter exhibits detergent properties in the final composition. In order to ensure that an oil-out emulsion is formed, it is preferable that the low HLB emulsifier be present in a greater amount than the high HLB emulsifier. The ratio of low HLB emulsifier to high HLB can range from 10:1 to 2:1 and preferably about 5:1 to 3:1. One suitable and preferred system comprises a sorbitan fatty acid ester (low HLB) and an alkyl- or dialkylphenoxypoly (ethyleneoxy) ethanol (high HLB). The fatty acid ester portion of the sorbitan fatty acid ester may be, for example, 1, 2, or 3 alkyl chains of oleate, stearate, laurate, palmitate, or $C_{8-20}$. This would include such things as a sorbitan sesquioleate (e.g., Arlacel C, sold by ICI America). The high HLB component may, for example, contain 1 or 2 alkyl $C_9$ groups, and about 6–30 ethyleneoxy groups. One suitable high HLB emulsifier is Igepal, more particularly Igepal DM-710, sold by Rhone-Poulenc. The preferred amounts of these two emulsifiers would fall within the range referred to above, with the low HLB emulsifier being present at a greater amount than the high HLB emulsifier so that the oil-out emulsion is maintained, while still providing an easily breakable emulsion. Preferred amounts of these two surfactants are about 0.1% to about 1% of the high HLB emulsifier 0.01% to about 0.1% of the low HLB emulsifier. Specifically, the preferred amounts are about 0.15% to about 0.26% sorbitan ester and about 0.01% to about 0.05% Igepal.

One added beneficial property of the high HLB emulsifier is its detergency. Thus, Igepal and similar emulsifying compounds are effective cleaners, especially for water-soluble stains. Since glycol ethers have surfactant properties, one would expect that their presence would interfere with the compatible emulsifier system. In fact, the glycol ethers generally have relatively high HLB values, and thus one might also expect that compatibility could be achieved with a reduction in the amount of Igepal or similar high HLB surfactant being employed. This, of course, is not desirable due to the detergency of Igepal and similar substances (e.g., alkyl- or dialkylphenoxpoly (ethyleneoxy) ethanols). Applicants have found, however, that the glycol ethers utilized in the compositions of the present invention within the concentration ranges disclosed do not interfere with the emulsifier system to any great extent, and it is still possible to utilize the same amount of Igepal as in the prior compositions while still maintaining the readily breakable oil-out emulsion.

As a summary of the foregoing, the following is the composition of one presently preferred cleaning and dusting composition (by weight %) and its corresponding final consumer product (after combination with a suitable propellant such as A-31 Propellant; hereinafter referred to as composition B):

| | Cleaning and Dusting Composition | Wt % Final Consumer Product |
|---|---|---|
| Sunpar LW 107 | 18.0 | 14.80 |
| Isopar E | 17.1 | 14.00 |
| Orange Terpene | 2.4 | 2.00 |
| Hexyl Cellosolve | 0.5 | 0.40 |
| Sorbitan Sesquioleate | 0.26 | 0.21 |
| Igepal 710 | 0.05 | 0.04 |
| Preservative | 0.06 | 0.05 |
| Fragrance | 0.4 | 0.30 |
| Orange Oil | 0.5 | 0.40 |
| Deionized Water | 60.73 | 49.8 |
| A-31 Propellant | — | 18.00 |

As indicated above, the final consumer product has only 34% VOC's, yet it has been found to have superior cleaning properties, shine imparting capability, and improved "rub-out", while also maintaining equivalent dust pick-up of prior compositions. Rub-out simply means that the product can be easily rubbed off of the surface being cleaned, thereby leaving the desired clear shine. Obviously a reduction in the amount of solvent present would be expected to inhibit ease of rub-out, however quite the contrary is observed with the products according to the present invention.

As those skilled in the art will understand, the method by which the dusting and cleaning compositions of the present invention are prepared can be significant. If the proper procedure is not followed, a proper emulsion will not be formed, and the desired oil-out emulsion may not form at all. As a first step, all of the nonaqueous components (namely the oil, solvent, terpene, glycol ether and orange oil, if the latter is utilized) are charged to a suitable mixing device. After these components have been mixed, the oil-soluble (i.e., low HLB) surfactant is added. Next, the water-soluble (i.e., high HLB) surfactant can be added, as this component will couple with the oil-soluble surfactant already present, thereby forming a uniform mixture. At this point, the water may be slowly added to the mixture, and the oil-out emulsion will thereby be formed. After about 50% of the necessary water has been added, any preservatives or other ionic/inorganic components may be slowly added either with the water stream or into the batch itself. In this manner, it will be ensured that the preservative and other ionic/inorganic components will not interfere with the formation of the emulsion. Once all of these components have been added, the solution is then shear-mixed in order to reduce the size of the emulsion droplets, thereby making the oil-out emulsion more stable. In typical batches, approximately two hours of shear mixing should be sufficient. Finally, any fragrances employed are added as the final step, since adding them sooner might cause their fragrancy to be lost due to the mixing.

EXAMPLE 1

Cleaning and dusting compositions such as the present are rather difficult to quantitatively compare with one another. In order to accurately determine whether or not the composition according to the present invention would provide unexpectedly improved properties, a panel of experienced furniture product testers were utilized. In all of the comparative cleaning tests, the testing protocol was essentially the same. The stain to be tested was applied as equal side-by-side marks on the furniture surface (either a varnish or lacquered wood finish, or a formica-topped material). The marks were then each sprayed with equivalent amounts of the two products to be tested, and each mark wiped with an equivalent number of passes. To ensure uniform wiping, a dual-headed wiping device was utilized. This device comprised two wood blocks joined by a handle. The surface of each block was covered with polyurethane foam (½"), which in turn was covered with cheesecloth. In order to eliminate torque and thereby ensure equal and minimum pressure on the blocks. Between subsequent tests, the furniture surface was cleaned with a hydrocarbon solvent in order to ensure that all remaining stain from prior tests had been removed. The marks to be tested varied in composition depending upon which set of tests were performed, and both greasy and/or waxy stains and water-soluble stains were employed. Examples of greasy and/or waxy materials used include crayons, and beeswax. Examples of water-soluble stains include colas, and various other food products.

In order to compare cleaning results, the panel of testers (15) were asked to judge which of the two cleaners performed best. Each was asked to judge which portion on the furniture surface appeared to be cleaner according to the following scale:

0=no difference
1=I think this side is cleaner
2=I know this side is a little cleaner
3=This side is a lot cleaner
4=This side is a whole lot cleaner In order to statistically analyze the results, an analysis of variance for a paired comparison was performed according to known statistical methods. The cleaning value for the control was typically set at 0.000, and the cleaning "score" for the product being tested was compared to this value. If the cleaning score for the test product is greater than zero and greater than the LSD (least significant difference, 95% confidence level), then the cleaning ability for the test product on the particular stain is greater than the control.

Composition A (previous composition) described above was mixed with a propellant (18% propellant/82% cleaning composition) in order to provide a product having a VOC content of 38%. Comparative compositions were also prepared wherein the VOC was successively reduced merely by decreasing the amount of volatile solvent present in the product (Isopar E). For comparison purposes, the cleaning value for composition A was assigned a value of 0.00. The following were the test results on greasy/waxy stains:

| % VOC's | Cleaning Value |
|---|---|
| 38% | 0.00 |
| 35% | −0.81 |
| 32% | −2.55 |
| 25% | −3.05 |

Based upon the above results, it is apparent that merely reducing the amount of volatile solvent employed in the composition in order to reduce VOC levels results in a product that is inferior in its ability to clean greasy/-waxy stains.

EXAMPLE 2

Tests were then performed comparing the cleaning ability of composition A with propellant (previously used compositions) and Composition B (a composition according to the present invention). The two compositions were also prepared with the addition of the optional fragrance, and all four compositions were tested both greasy/waxy stains, water based stains (coffee), and food stains (water-soluble). The results of these tests are shown below, wherein the composition A cleaning value for each type of stain was once again assigned a value of 0.000 for comparison purposes:

| | Cleaning Value | | LSD @ 95% |
|---|---|---|---|
| | A | B | |
| Water based (coffee) | 0.000 | 2.470 | 0.202 |
| Waxy/greasy | 0.000 | 0.480 | 0.250 |
| Food Stain | 0.000 | 1.160 | 0.276 |
| | A + frag. | B + frag. | |
| Water based (coffee) | 0.000 | 3.000 | 0.152 |
| Waxy/greasy | 0.000 | 0.760 | 0.258 |
| Food Stain | 0.000 | 1.820 | 0.364 |

Since even when utilizing experienced product testers there is a degree of subjectively, some of the testers occasionally felt that composition A (with or without fragrance) was performing better. However, the statistical analysis of the results (as described previously), performed in a manner commonly relied upon by those skilled in the art for comparing testing results that have a degree of subjectivity, certainly indicates the superiority of the compositions made according to the present invention in terms of cleaning ability for waxy/greasy stains, water based stains, and food stains. This type of testing and accompanying statistical analysis is commonly employed in the art for comparing the cleaning ability of two products, and thus is considered reliable. Interestingly, the improvement in cleaning strength was slightly improved when the fragrance was present, most likely due to the presence of a slightly additional amount of solvent.

It will be understood that modifications may be made in the invention without departing from the spirit of it. For example, numerous types of oils and volatile solvents may be utilized in place of those specified as being preferred. Accordingly, the scope of the present invention should be considered in terms of the following claims, and it is understood not to be limited to that shown and described in the specification.

What is claimed is:

1. A cleaning and dusting oil-out emulsion composition comprising:

a) from about 5% to about 40% by weight of a paraffinic or naphthenic oil;

b) from about 0.5% to about 20% by weight of a petroleum solvent;

c) from about 0.5% to about 20% by weight of a terpene;

d) a sufficient amount to improve cleaning properties while maintaining the oil-out emulsion of a glycol ether;

e) from about 0.1% to about 2% by weight of an emulsion system comprising a low HLB emulsifier and a high HLB emulsifier wherein the low HLB emulsifier is present in a greater amount in said system; and f) the remainder water.

2. The composition according to claim 1 wherein the terpene is selected from terpinenes, terpinolenes, limonenes, pinenes and mixtures thereof.

3. The composition according to claim 1 wherein the terpene is orange terpene.

4. The composition according to claim 2 wherein the terpene is d-limonene.

5. The composition according to claim 1 wherein the concentration of paraffinic or naphthenic oil ranges from about 12% to about 20% by weight.

6. The composition according to claim 1 wherein the concentration of petroleum solvent is from about 12% to about 20% by weight.

7. The composition according to claim 1 wherein the glycol ether is selected from diethylene glycol monobutyl ether, diethylene glycol monohexyl ether, ethylene glycol monobutyl ether, ethylene glycol monohexyl ether and mixtures thereof.

8. The composition according to claim 7 wherein the glycol ether is ethylene glycol monohexyl ether.

9. The composition according to claim 7 wherein the concentration of glycol ether is from about 0.1% to about 1% by weight.

10. The composition according to claim 1 wherein the ratio of low HLB emulsifier to high HLB emulsifier ranges from 10:1 to 2:1.

11. The composition according to claim 10 wherein said ratio is from 5:1 to 3:1.

12. The composition according to claim 10 wherein the one emulsifier has an HLB characteristic of about 2–6 and the other emulsifier has an HLB of about 8–18.

13. The composition according to claim 1 including an aerosol propellant.

14. A cleaning and dusting oil-out emulsion composition comprising:

a) about 18 weight percent of a light paraffinic petroleum distillate having a molecular weight of about 250–300 and viscosities of about 50–100 SUS/100° F.;

b) about 17.1 weight percent of a petroleum solvent;

c) about 2.4 weight percent of an orange terpene;

d) about 0.5 weight percent ethylene glycol monohexyl ether;

e) about 0.26 weight percent sorbitan sesquiolate;

f) about 0.06 weight percent preservative;

g) about 0.4 weight percent fragrance; and

15. The composition of claim 14 including a propellant.

* * * * *